US007209675B2

(12) United States Patent
Matsusaka et al.

(10) Patent No.: US 7,209,675 B2
(45) Date of Patent: Apr. 24, 2007

(54) IMAGE FORMING APPARATUS

(75) Inventors: Susumu Matsusaka, Kanagawa (JP); Kazuhito Kishi, Kanagawa (JP); Yasuhisa Kato, Kanagawa (JP); Akiyasu Amita, Kanagawa (JP); Masami Okamoto, Kanagawa (JP); Yasutada Tsukioka, Chiba (JP); Hiromasa Takagi, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 167 days.

(21) Appl. No.: 11/049,718

(22) Filed: Feb. 4, 2005

(65) Prior Publication Data

US 2005/0175370 A1 Aug. 11, 2005

(30) Foreign Application Priority Data

Feb. 5, 2004 (JP) ..... 2004-029371

(51) Int. Cl.
*G03G 15/00* (2006.01)

(52) U.S. Cl. ..... 399/88; 399/67; 399/68

(58) Field of Classification Search ..... 399/38, 399/67, 68, 69, 75, 88; 219/497
See application file for complete search history.

(56) References Cited

U.S. PATENT DOCUMENTS 7,145,111 B2 * 12/2006 Hori ..... 219/497
2005/0047810 A1 * 3/2005 Nagatsuma et al. ..... 399/69
2005/0175370 A1 8/2005 Matsusaka et al.

FOREIGN PATENT DOCUMENTS

JP 2002-174899 6/2002

OTHER PUBLICATIONS

U.S. Appl. No. 11/221,838, filed Sep. 9, 2005, Kishi et al.
U.S. Appl. No. 11/283,828, filed Nov. 22, 2005, Okamoto.
U.S. Appl. No. 11/405,448, filed Apr. 18, 2006, Kishi et al.
U.S. Appl. No. 11/522,324, filed Sep. 18, 2006, Semma, et al.

* cited by examiner

*Primary Examiner*—Hoan Tran
(74) *Attorney, Agent, or Firm*—Oblon, Spivak, McClelland, Maier & Neustadt, P.C.

(57) ABSTRACT

A fixing member, a power detector, and a controller are included. The fixing member is heated by a heating unit that generates heat when power is supplied by a commercial power and a capacitor. The power detector detects energy of power stored in the capacitor. The controller performs an identical control to reduce number of copies of an image formed (fixed) per minute (CPM) to a predetermined number (40 CPM) in any of three cases in which the energy is less than a threshold for starting electric discharge when a plurality of recording mediums is continuously passed through the fixing member, in which a cardboard paper is continuously passed, and in which an amount of data of an image to be transferred on the recording medium is large.

3 Claims, 6 Drawing Sheets

IMAGE FORMING APPARATUS

CROSS-REFERENCE TO RELATED APPLICATIONS

The present document incorporates by reference the entire contents of Japanese priority document, 2004-029371 filed in Japan on Feb. 5, 2004.

BACKGROUND OF THE INVENTION

1) Field of the Invention

The present invention relates to an image forming apparatus that includes a fixing-unit system with a capacitor that supplies electric power to a heating section.

2) Description of the Related Art

In copy machines, printers, and facsimiles nowadays, it is a common technique to fix a toner image on a recording medium by heating toner in the toner image with a fixing unit. The toner image is formed by an electrophotography on the recording medium such as a transfer paper, and then, the recording medium is passed through the fixing unit.

In such a fixing unit, a roller or an endless belt is heated by heat from a heating section that is supplied with electric power. A fixing member such as the roller or the endless belt is allowed to make a contact with the recording medium to heat the toner. In this case, so far, the power has normally been supplied to the heating section by a commercial ac power supply. However, a fixing-unit system that supplies the power to the heating section together with a capacitor has been developed recently. An example of such a fixing-unit system is disclosed in Japanese Patent Application Laid-open Publication No. 2002-174988.

In an image forming apparatus, shortening of a total copying time from a start up of the apparatus up to an end of copying, has been sought after. While starting up by putting a main power supply ON when the fixing-unit system is at halt, if a power stored in the capacitor is not less than a threshold for starting electric discharge, the power can be supplied to a plurality of heating sections by respective commercial ac power supply and capacitor and a temperature can be raised up rapidly up to a reload temperature, thereby shortening a waiting time till the apparatus can be used, which in turn enables to shorten the total time required for copying.

However, even in such an image forming apparatus, the apparatus is structured to perform control by giving priority to securing an image quality. Therefore, while passing the paper continuously, if energy of power stored in the capacitor is less than the threshold for starting electric discharge, a CPM (copies per minute) down control in which number of images formed per minute or number of images fixed per minute (CPM) are reduced, i.e. paper-passing speed is reduced to a speed slower than a normal speed, has been performed for preventing defective fixing.

Apart from this, while passing a cardboard paper or passing a paper with a large image data to be transferred, due to a very big drop in a temperature of the fixing member, in a case of the cardboard paper for example, the CPM down control called as a board-paper mode is performed to prevent the defective fixing and to secure the image quality.

Therefore, an image forming apparatus that includes a capacitor, has been provided with a control mode for normal CPM conditions, the CPM down control mode for a shortage of power stored in the capacitor, and a CPM down control mode for passing the cardboard paper. In order that each mode is use appropriately, the structure of the control system has been complicated.

Moreover, while passing the cardboard paper, a drop in temperature of the fixing member is detected while the cardboard paper is being passed and for reducing the CPM, a time is required to adjust the CPM in the image forming apparatus, thereby resulting in more time required for copying.

SUMMARY OF THE INVENTION

It is an object of the present invention to solve at least the above problems in the conventional technology.

An image forming apparatus according to one aspect of the present invention includes a capacitor that is charged by a commercial power; a heating unit that is heated by power supplied by the commercial power and the capacitor; a fixing member that is heated by the heating unit, and that applies heat on an image to be fixed to fix the image on a recording medium; a power detector that detects energy of power stored in the capacitor; a judging unit that judges whether it is possible to supply power to the heating unit from the capacitor when a plurality of the recording mediums is continuously passed through the fixing member; and a controller that performs a reducing control to reduce number of copies of the image formed per minute, when the judging unit judges that it is impossible to supply the power to the heating unit from the capacitor.

The other objects, features, and advantages of the present invention are specifically set forth in or will become apparent from the following detailed description of the invention when read in conjunction with the accompanying drawings.

DETAILED DESCRIPTION

Exemplary embodiments of an image forming apparatus according to the present invention will be described in detail with reference to the accompanying drawings.

Figure 4:
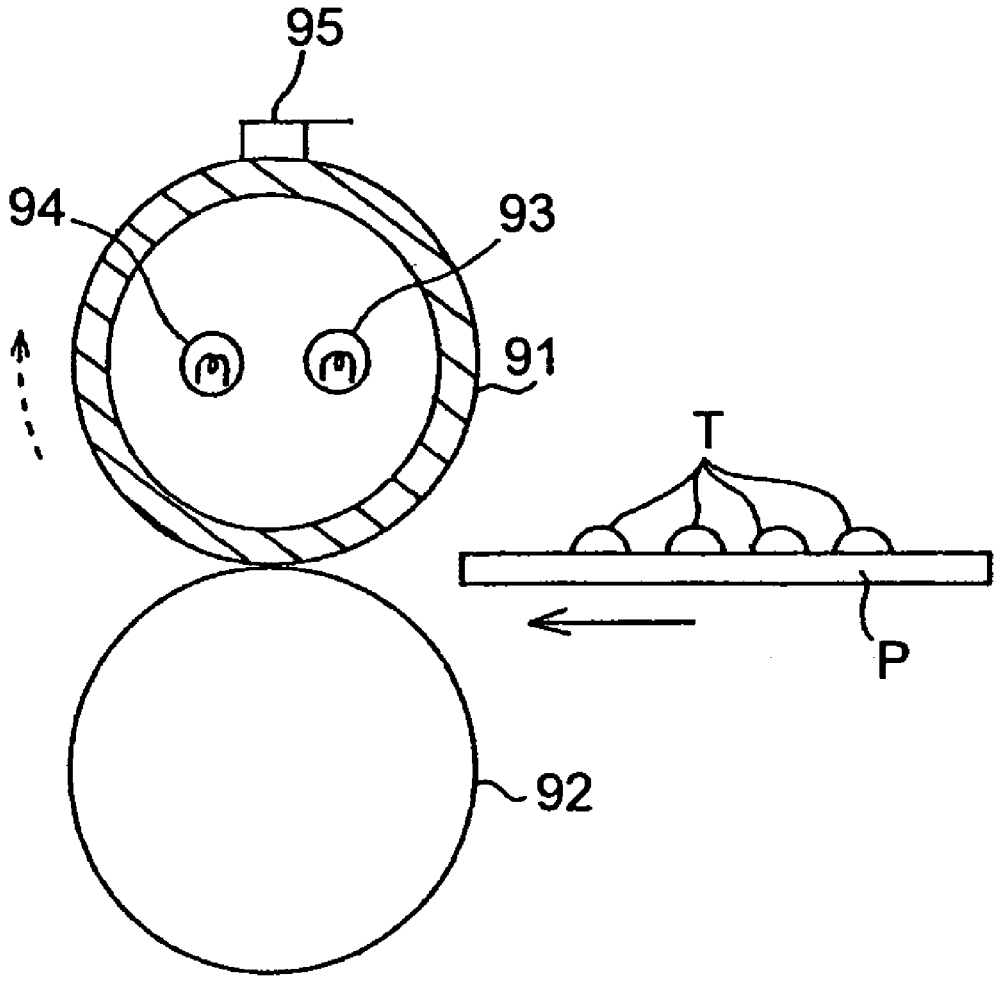
FIG. 4 is a schematic of a fixing unit according to the first embodiment.

An example of a fixing unit is illustrated in FIG. 4. The fixing unit shown in FIG. 4 includes a fixing roller (fixing member) 91, a pressurizing roller (fixing member) 92, and a temperature sensor (temperature detecting section) 95. The fixing roller 91 is heated by heaters 93 and 94 in a heating section, and rotates in a clockwise direction. The pressurizing roller 92 is pressed against the fixing roller 91 with a fixed nip pressure and rotates is a counterclockwise direction. The temperature sensor 95 is in contact with the fixing roller 91 and detects a temperature of a surface of the fixing roller 91.

The fixing roller 91 is normally a hollow cylindrical roller and may also be in the form of an endless belt. The fixing roller 91 is at halt at a time of start-up of the fixing unit and rotates in the clockwise direction when a sheet P that is a recording medium is passed.

The pressurizing roller 92 is normally a cylindrical roller that includes an elastic material such as silicone rubber on its surface and it may be in the form of an endless belt as well. A pressurizing unit that is not shown in the diagram causes the pressurizing roller 92 to press against the fixing roller 91 with a fixed pressure. The pressurizing roller 92 is at halt at the time of start-up of the fixing unit and rotates in the counterclockwise direction when the sheet P that is a recording medium is passed. A drive mechanism that is not shown in the diagram rotates the fixing roller 91 and the pressurizing roller 92.

The heaters 93 and 94 are disposed in a hollow portion of the fixing roller 91. However, the heaters 93 and 94 may be disposed as sheet heaters covering an outer side of the fixing roller 91.

The heater 93 generates heat when power is supplied by an outer power supply such as a commercial power supply (hereinafter, "commercial power supply") and the fixing roller 91 is heated by radiant heat from the heater 93.

The heater 94 generates heat when power is supplied by a capacitor and the fixing roller 91 is heated by radiant heat from the heater 94.

Thus, the heaters 93 and 94 generate heat when the power is supplied, and heat the fixing roller 91. However, there is no restriction on a type of the heater and the fixing roller can be disposed in any desired position where it can be heated.

The temperature sensor 95 may be a contact type sensor or a non-contact type sensor such as a radiation thermometer or a thermo couple, provided that it can detect the temperature of the surface of the fixing roller 91.

While forming an image by the image forming apparatus using an electrophotography, the sheet P on which toner T that is an unfixed toner image is held, passes through a nip formed by the fixing roller 91 and the pressurizing roller 92. While passing through the nip, the sheet P is heated by the fixing roller 91 and the pressurizing roller 92 and the toner T is fixed on the sheet P. A predetermined temperature is necessary for fixing the toner T on the sheet P. Therefore, the power supply to the heaters 93 and 94 is controlled such that the temperature of the surface of the fixing roller 91 becomes a reload temperature, which is a temperature that enables fixing of the toner T.

Figure 5:
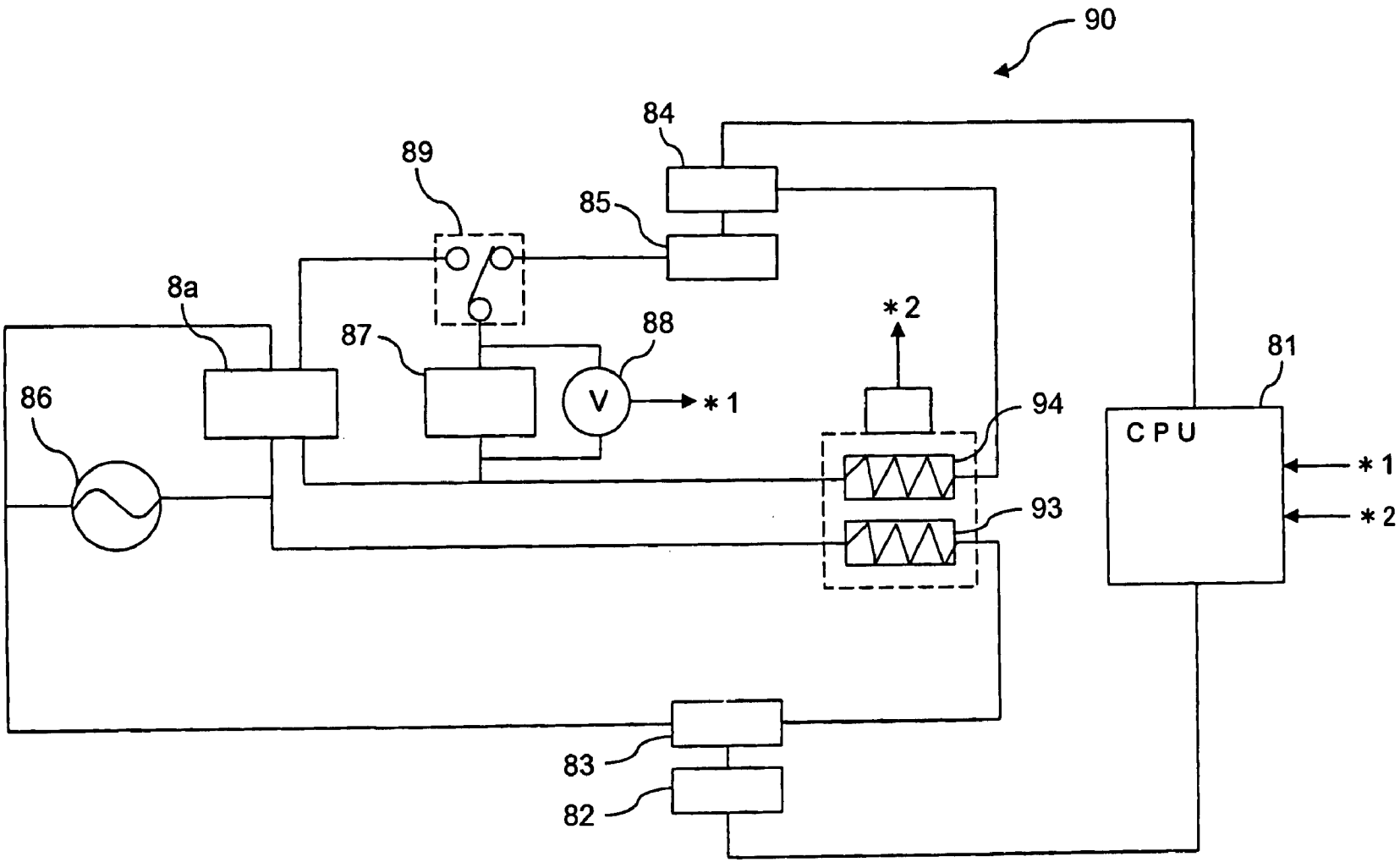
FIG. 5 is a schematic of a circuit of a conventional fixing-unit system.

FIG. 5 is a schematic of a circuit of a fixing-unit system. The heater 93 shown in FIG. 5 generates heat when the power is supplied by a commercial power supply (outside power supply) 86 and the heater 94 generates heat when the power is supplied by a capacitor 97 that is an electricity-storage. It is desirable that the heater 94 includes a plurality of heaters connected in parallel to the capacitor 87. An arrangement may be such that any one of these heaters or all the heaters are connected to the capacitor 87 by switching a switch that is not shown in the diagram. For example, an arrangement can be made that at the time of start-up of the apparatus, both the heaters 93 and 94 are connected to the capacitor 87, and while the paper is being passed, any one heater that is selected is connected to the capacitor 87.

It is desirable that the capacitor 87 is a capacitor such as an electric double layer capacitor that has an electrostatic capacity not less than that of a farad order. A power detector 88 is connected to the capacitor 87.

A capacitor voltage that is an indicator of the stored-power energy (amount of power remained) of the capacitor 87 that is detected by the power detector 88, and the temperature of the fixing roller 91 that is detected by the temperature sensor 95 are fetched as detection signals via an input circuit to a central processing unit (CPU) 81 that is a controller. The CPU 81 causes controllers 82 and 84 to control a supply of electricity to the heater 93 via a triac 83 and a supply of electricity to the heater 94 via an FET (field effect transistor) 85 such that the temperature of the surface of the fixing roller 91 becomes same as a set temperature, based on the detection signal from the temperature sensor 95. The capacitor 87 is connected to a charging unit 8*a* by switching of the switch 89 and can be charged.

Figure 6:
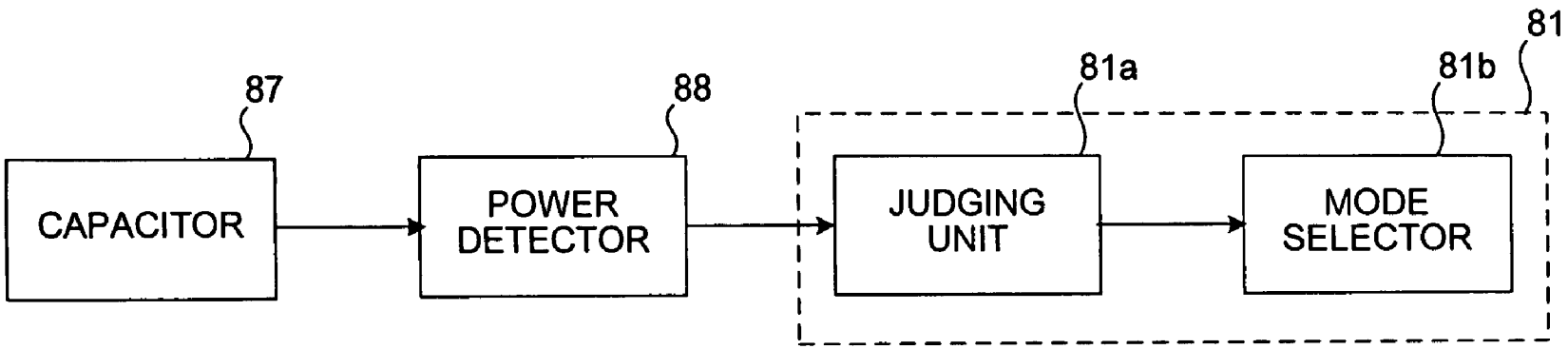
FIG. 6 is a block diagram of the conventional fixing-unit system.

FIG. 6 is a block diagram of the fixing-unit system.

As shown in FIG. 6, a CPU 81 includes a judging unit 81*a* and a mode selector 81*b*. The judging unit 81*a* is let to have a threshold value related to a capacitor voltage that is set in advance and the mode selector 81*b* has a plurality of control modes. The control modes include granting of a permission and not granting of a permission to supply power from the capacitor 87 to the heater 94 at the time of start-up and during the paper passing, and setting of CPM (copies per minute) according to the granting and not granting of the permission to supply power from the capacitor 87 to the heater 94.

The control modes that are selected by the mode selector 81*b* include at least modes 91, 92, and 93 shown in table 1 below.

TABLE 1

| | | CPM control | | Detection information | | |
|---|---|---|---|---|---|---|
| Mode | CPM | Linear velocity | Paper interval | Recording medium | Amount of image data | Capacitor |
| 91 | 75 | a | L | ordinary paper | small | used |
| 92 | 40 | b | L | cardboard paper | large | — |
| 93 | 50 | a | m | — | — | not used |

(where a > b, L < m)

When the recording medium is an ordinary paper and the amount of image data (to be transferred) is small, the mode selector 81*b* selects a mode 91 as shown in table 1. When the mode 91 is selected, a rotational speed of a transporting section (i.e. a drive roller) that transports the recording medium (ordinary paper) to the fixing roller 91 and a linear velocity that is a passing speed of the recording medium, which is determined by a fixing speed or the rotational velocity of the fixing roller 91, are set to a linear velocity a, which is a comparatively higher velocity. Moreover, a paper interval that is an interval between the recording mediums (ordinary papers) is set to a comparatively shorter paper interval L, and the apparatus is controlled such that the number of copies per minute becomes 75. Furthermore, while passing the paper continuously, the setting is done such that with the generation of heat from the heater 93, the capacitor 87 is allowed to discharge power to the heater 94 to generate heat.

When the recording medium is a cardboard paper (recording medium that has a high heat capacity) or when the amount of image data (to be transferred) is large, the mode selector 81*b* selects a mode 92 as shown in table 1. When the mode 92 is selected, the rotational speed of the transporting section (i.e. a drive roller) and the linear velocity that is a passing speed of the recording medium, which is determined by the fixing speed or the rotational velocity of the fixing roller 91, are set to a linear velocity b, which is the lowest speed among the modes 91 to 93. Moreover, the paper interval that is an interval between the recording mediums (ordinary paper) is set to a comparatively shorter paper interval L, and the apparatus is controlled such that the number of copies per minute becomes 40.

While passing the paper continuously, if the power stored in the capacitor 87 is less than the threshold for starting electric discharge, the mode selector 81*b* selects a mode 93. When the mode 93 is selected, the copies per minute are set to 50, and the rotational speed of the transporting section (drive roller) and the linear velocity of the recording medium, which is determined by the fixing speed or the rotational velocity of the fixing roller are set to the linear velocity a. Moreover, the paper interval is set to a comparatively longer paper interval m, and the apparatus is controlled such that the number of copies per minute becomes 50. Furthermore, in a case of the mode 93, while the paper is passed continuously, the setting is done such that the discharge from the capacitor 87 is not allowed to take place and the fixing is performed by the heat generated by the heater 93.

Thus, in each of the control modes viz. the control mode with 75 CPM when the paper is passed continuously, in the case where the recording medium is an ordinary paper and the amount of image data to be transferred is small, the control mode with 40 CPM, where the recording medium is a cardboard paper (recording medium that has high heat capacity) or the amount of image data to be transferred is large, and the control mode with 50 CPM, where the power stored in the capacitor during the continuous passing of the paper is less than the threshold for starting electric discharge, the control is different from that of the other. From this point of view, the designing, making, and simulation of the control program has been taking a long time and a large amount of labor is required.

A first embodiment of a fixing-unit system in an image forming apparatus according to the present invention is described below. Although, an example of a fixing-unit system during continuous passing of the paper is described in the first embodiment, the present invention is not restricted to this case only.

Figure 1:
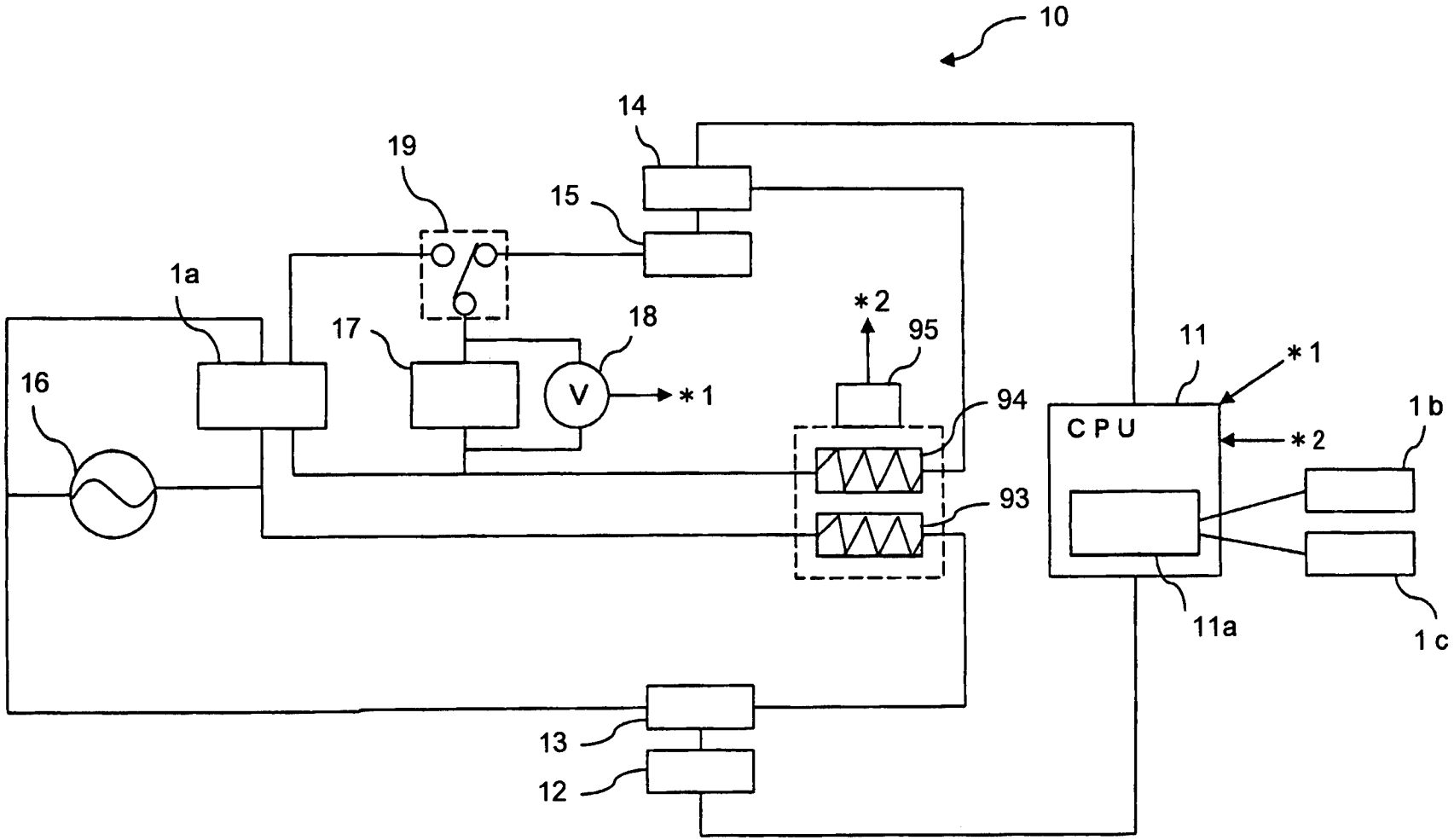
FIG. 1 is schematic of a circuit of a fixing-unit system according to a first embodiment of the present invention.

FIG. 1 is a schematic of a circuit of a fixing-unit system according to a first embodiment of the present invention.

In a fixing-unit system 10, an operation of a CPU 11 is different from that in the structure shown in FIG. 5 that is a prerequisite for the first embodiment, which is an only point of difference. The rest of the structure is basically the same as that shown in FIG. 5. In other words, the fixing-unit system 10 includes a commercial power supply 16 that is connected to the heater 93, a capacitor 17 that is connected to the heater 94, a power detector 18 that is connected to the capacitor 17, a triac 13 and a controller 12 that are related to control of a power supply from the commercial power supply 16, a controller 14 and a FET 15 that are related to control of a power supply from the capacitor 17, a switch 19, and a charging unit 1*a*. The capacitor 17 is a bank structure in which 20 electric double layer capacitors each having a capacity of 500 F, and 2.5 V per cell are used. The heater 93 has a rated power 900 W and the heater 94 includes two heaters of rated power 1000 W and 800 W respectively, connected in parallel. A fixing unit is similar to that with a structure shown in FIG. 4.

Figure 2:
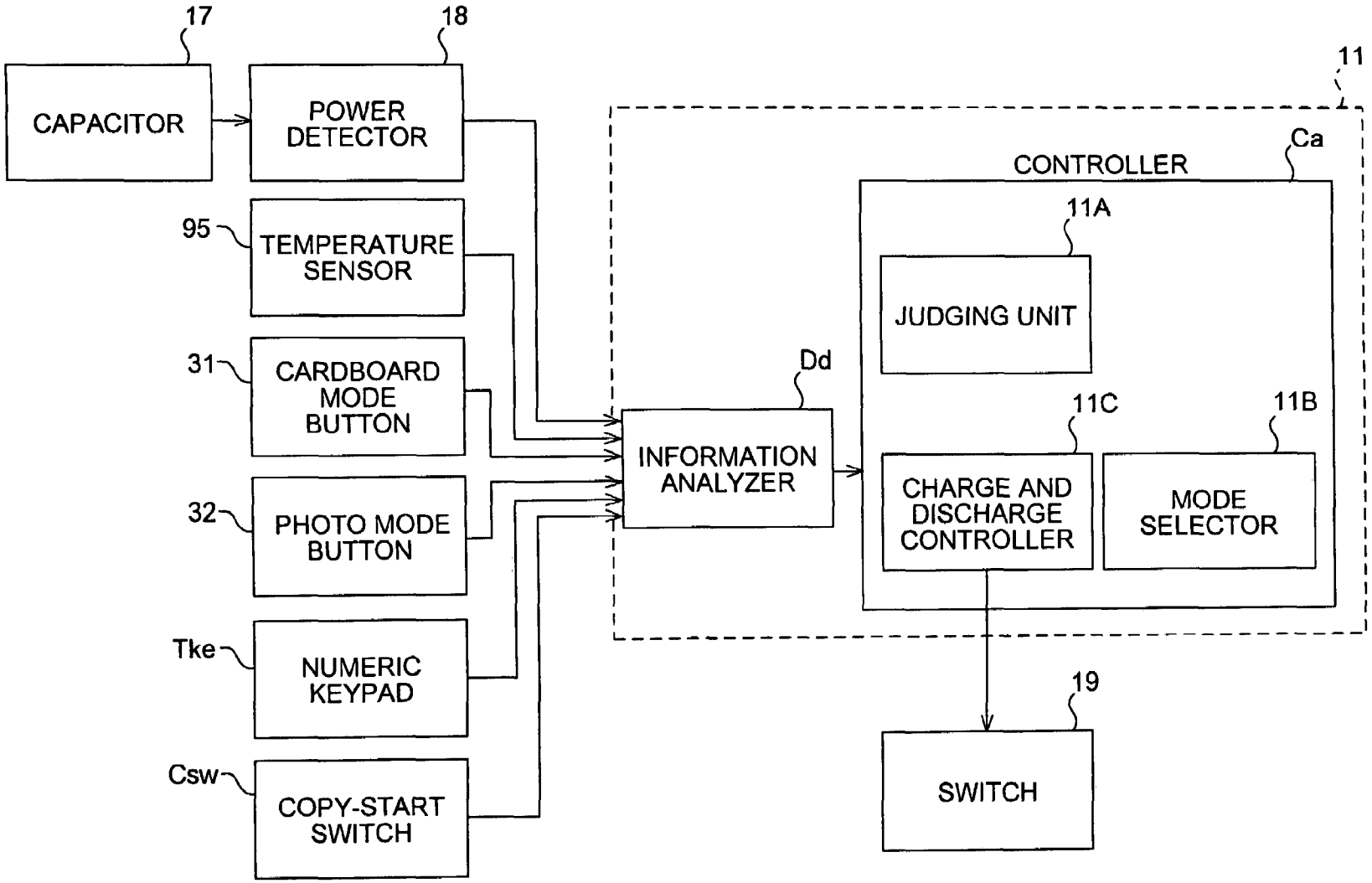
FIG. 2 is a block diagram of the fixing-unit system.

FIG. 2 is a block diagram of the fixing-unit system according to the first embodiment. As shown in FIG. 2, the CPU 11, firstly, causes a processor Ca to perform progressive functioning of a judging unit 11A, a mode selector 11B, and a charge and discharge controller 11C based on a control program. The judging unit 11A makes a judgment of whether the power stored in the capacitor 17 during the continuous passing of the paper is not less than or not greater than the threshold for starting electric discharge and a judgment of whether the energy after charging the capacitor 17 is greater than a charging-completion threshold value. The judging unit 11A further makes a judgment of whether it is a case of continuous passing of the cardboard paper or a case of continuous passing of a paper when the amount of image data to be transferred to the each of the recording mediums is large. The mode selector 11B selects a mode 1 for a normal number of copies per minute (75 CPM) when the power stored in the capacitor 17 during the continuous passing of the paper is judged to be not less than the threshold for starting electric discharge. The mode selector 11B selects a mode 2 when the power stored in the capacitor 17 during the continuous passing of the paper is judged to be less than the threshold for starting electric discharge or when the cardboard paper that has a high heat capacity (or a recording medium that has a large width) is passed continuously, or the case of continuous passing of the paper when the amount of image data to be fixed is large, is judged. When the mode 2 is selected, the copy operation is performed by reducing the number of copies per minute from 75 CPM to 40 CPM at which the image quality is secured. The charge and discharge controller 11C controls charging and discharging of the capacitor 17 (i.e. controls the switch 19).

The CPU 11, secondly, allows an information analyzer Dd to be connected electrically to each of a numeric keypad Tke, a copy-start switch Csw that designates number of copies, apart from the power detector 18, the temperature sensor 95, a cardboard mode button 31, and a photo mode button 32, to enable to fetch information. In other words, CPU 11, during the continuous passing of the paper, fetches information about a capacitor voltage that is the indicator of the stored-power energy (amount of power remained) of the capacitor, which is detected by the power detector 18, and information about the temperature of the fixing roller 91, as a detection signal. Other details are mentioned in the later part.

The judging unit 11A, when makes a judgment of the power stored in the capacitor 17, it makes it by acknowledging detection information that is output by the power detector 18. The judging unit 11A, when makes a judgment of continuous passing of the cardboard paper, makes it based on detection information when the cardboard mode button 31 is put ON during the continuous passing. Further, the judging unit 11A, when makes a judgment of continuous passing when the amount of image data to be fixed on the each of the recording mediums is large, it makes it based on detection information when the photo mode button 32 is put ON. The judging unit 11A may also be allowed to make a judgment of whether the amount of image data to be fixed is large or small based on whether images formed are monochrome or color. In this case, the judgment may be allowed to be made based on detection information when a button for selecting a monochrome and a color mode is operated. The judging unit 11A judges the number of copies to be fixed to be small when the monochrome mode is selected and judges the number of copies to be fixed to be large when the color mode is selected.

The mode selector 11B has a plurality of control modes. The control modes include granting of permission and not granting of a permission to supply power from the capacitor 17 to the heater 94 at the time of start-up and during the paper passing, and setting of CPM according to the granting and not granting of the permission to supply power from the capacitor 17 to the heater 94. Control parameters during the mode 1 and the mode 2 according to the present invention are set in advance as shown in table 2 below.

TABLE 2

| | | CPM control | | Detection information | | |
|---|---|---|---|---|---|---|
| | | | | | Amount of | |
| Mode | CPM | Linear velocity | Paper interval | Recording medium | image data | Capacitor |
| 1 | 75 | a | L | ordinary paper | small | used |
| 2 | 40 | b | L | cardboard paper | large | not used |

(a > b)

When the recording medium is an ordinary paper and the amount of image data (to be transferred) is small, the mode selector 11B selects the mode 1. When the mode 1 is selected, the rotational speed of a transporting section (i.e. a drive roller, which is not shown) that transports the recording medium (ordinary paper) to the fixing roller 91 and the linear velocity that is a passing speed of the recording medium, which is determined by the fixing speed or the rotational velocity of the fixing roller 91, are set to the linear velocity a, which is a comparatively higher velocity. Moreover, the paper interval that is an interval between the recording mediums (ordinary papers) is set to the comparatively shorter paper interval L and the apparatus is controlled such that the number of copies per minute becomes 75. Furthermore, while passing the paper continuously, the setting is done such that with the generation of heat from the heater 93, the capacitor 17 is allowed to discharge (capacitor is used) power to the heater 94 to generate heat.

When the power stored in the capacitor 17 is less than the threshold for starting electric discharge during the continuous passing of the paper, if the recording medium is a cardboard paper (recording medium that has high heat capacity) or when the amount of image data (to be transferred) is large, the mode selector 11B selects the mode 2. When the mode 2 is selected, the rotational speed of the transporting section (i.e. a drive roller) and the linear velocity that is the passing speed of the recording medium, which is determined by the fixing speed or the rotational velocity of the fixing roller 91, are set to the linear velocity b, which is lower than that in the mode 1. Moreover, the paper interval that is an interval between the recording mediums (cardboard paper) is set to the comparatively shorter paper interval L, and the apparatus is controlled such that the number of copies per minute becomes 40. When the paper is passed continuously, if the power stored in the capacitor 17 is less than the threshold for starting electric discharge, the setting is done not to use the capacitor 17 and to perform fixing by the generation of heat by the heater 93.

Firstly, when the recording medium (sheet P) is passed continuously and the paper is passed continuously through the fixing roller (fixing member) 91 (in other words copy-start in continuous passing of the paper), if the power stored in the capacitor 17 is not less than the threshold for starting electric discharge that is set in advance (for example 30 V), the charge and discharge controller 11C, controls the switch 19 to the discharge side to start the power supply from the capacitor 17 to the heater 94. In other words, the switch 19 is controlled by outputting a switch-controlling signal, for example by using a logic circuit or a relay contact.

Secondly, if the power stored in the capacitor 17 is less than the threshold for starting electric discharge, the charge and discharge controller 11C performs control such that the switch 19 may be turned to a charging side so that the power is supplied to the capacitor 17 by the commercial power supply 16 at least until the power stored in the capacitor 17 becomes the same as the threshold for starting electric discharge and when the power stored in the capacitor 17 becomes the same as the threshold for starting electric discharge, the switch 19 may be turned to a discharge side to start supplying the power from the capacitor 17 to the heater 94. This is how the charge and discharge controller 11C operates. The discharge control is performed when the copy-start switch Csw is already put ON (waiting for copy-start) or while putting the copy-start switch ON.

On the other hand, because the capacitor 17 is a bank structure in which 20 electric double layer capacitors having 2.5 V per cell in this example, the maximum power stored in the capacitor 17 is 50 V and if the stored-power energy required to generate the maximum heat from the heater 94 is 30 V, the threshold for starting electric discharge can be set to not less than 25 V or 30 V. The threshold value is to be set voluntarily according to a size of the fixing unit (fixing roller 91), a heat generation capacity set in advance of the heater 93 that generates heat upon supplying the power from the commercial power supply 16.

If the stored-power energy is increased from 27 V to the threshold for starting electric discharge (threshold value for charging completion) such as 30 V by supplying the power from the commercial power supply 16 to the capacitor 17, and if the increase by 1 V in the stored-power energy takes 5 s, then it takes 15 s for charging.

Examples of control modes where the number of copies per minute is set to 75 or 40 have been described. However, it is not restricted to 75 or 40 copies. On the other hand, if the threshold for starting electric discharge is to be set to a value such as 25 V or 30 V, then it is a range that can deal statistically and sufficiently with the total number of copies during continuous passing of the paper. In most of the cases with this range, unnecessary consumption of power can be avoided. However, the threshold for starting electric discharge is to be set suitably whenever necessary according to a type and size of a fixing-unit system (fixing roller 91) 10A i.e. according to a type and size of the image forming apparatus.

If the threshold for starting electric discharge (charging-completion threshold value) related to the capacitor voltage during the continuous passing of the paper (stored-power energy) is to be set according to the requirement and not in advance, a number of copies predicting section is included and based on information of total number of copies from the number of copies predicting section, the total number of copies is divided at a certain range of interval, a threshold value for charging completion is assigned for that range and is set to a value in a range corresponding to the information of the total number of copies from the number of copies predicting section. For example, if the threshold value is 25 V for number of copies less than n, if the total number of copies is not less than n, an increased threshold value such as 30 V may be let be the charging-completion threshold value. Or, to start with, a time for passing of the paper t1 when the paper is fed continuously with normal number of copies per minute, is calculated from the information of total number of copies. Then assuming the supply of power from the capacitor 17 to the heater 94 during the continuous passing of the paper, the capacitor voltage is calculated by reverse calculation by going back by the paper passing time t1 from a capacitor upper-limit voltage that is an upper limit for voltage at which the capacitor 17 can be discharged, and this value may be let to be the charging-completion threshold value. Information of the charging-completion threshold value that is set (in other words, threshold for starting electric discharge: such as 30 V), is judged by the judging unit 11A.

On the other hand, for the prediction of the total number of copies by the number of copies predicting section, a value obtained by multiplying information (based on operation of the numeric keypad Tke) of number of documents that is obtained during image reading by an image reading unit and information of number of copies that is input while giving copy command may be let to be the total number of copies. Moreover, number of copies that is calculated from information of the number of documents that is included in print-command information, which is input from an external input section (such as a information processing unit and a computer) and information of number of printouts may be let to be the total number of copies. Apart from this, the total number of copies may be predicted by detecting a change in voltage (change in current) according to a displacement of a reciprocating mobile body that has a roller at a front tip of an auto sheet feeder, or by detecting thickness of number of documents optically in the auto sheet feeder.

The following is a description of an example of an operation during the mode 1 (based on a control program for the mode 1) of the fixing-unit system according to the first embodiment. Preconditions are as given below.

threshold for starting electric discharge (during continuous passing): 25 V capacitor voltage at time of copy command: 27 V (s11) The copy-start button Csw is put ON and the information analyzer Dd in the CPU 11 detects a continuous-copy command.

(s12) The capacitor voltage (27 V) of the capacitor 17 is higher than the threshold for starting electric discharge (25 V) and the recording medium is an ordinary paper. Therefore, the judging unit 11A judges it to be a case where the amount of image data (to be transferred) is small. The mode selector 11B selects the mode 1. In other words, the control system is set such that a permission to supply power from the capacitor 17 to the heater 94 during the continuous passing of the paper is granted and the number of copies per minute is let to be 75.

(s13) Further, by an operation of the CPU 11, the velocity (rotational speed: i.e. linear velocity) of the transporting section (such as a drive roller) that carries the recording medium to the fixing roller 91 is set to the linear velocity a such that the velocity of the transporting section corresponds to 75 copies per minutes, and the interval between the recording mediums, i.e. the paper interval when the recording mediums are transported continuously is set to the paper interval L corresponding to 75 copies per minute. Further, the rotational velocity of the fixing roller 91 and the pressurizing roller 92 is set to be a velocity corresponding to 75 copies per minute.

(s14) Each of the main sections (including the fixing-unit system 10) involved in the continuous operation of the image forming apparatus is let to be in a standby state.

(s15) A start-up operation by supplying the power from the commercial power supply 16 to the heater 93 is performed. Here, information about temperature based on temperature measurement of the fixing roller 91 from the temperature sensor 95 is detected and a judgment of whether the fixing roller 91 has reached the reload temperature is made. The start-up operation of the fixing roller takes 30 s.

(s16) If the temperature of the fixing roller 91 has reached the reload temperature, the standby state of the main section (including the fixing-unit system) involved in the continuous-copy operation of the image forming apparatus is released and the copy-start switch Csw is let to be operative. The heater 93 continues to generate heat upon being supplied with power from the commercial power supply 16 and the heater 94 is caused to generate heat by discharge electric power (not less than 25 V) supplied from the capacitor 17, thereby heating the fixing roller 91 by the heat generated.

(s17) With the continuous copy operation, by heating of the fixing roller 91 and a nip pressure of the pressurizing roller 92, unfixed toner images are fixed one after another at the linear velocity a on each of the sheets P that are passed continuously at the speed of 75 copies per minute.

(s18) When the copying operation is completed, the capacitor 17 is charged by the commercial power supply 16 as a preparation for the next copying operation. The stored-power energy upon charging is 25 V.

The following is a description of an example of an operation during the mode 2 (based on a control program for the mode 2) of the fixing-unit system according to the first embodiment.

(s21) The copy-start button Csw is put ON and the information analyzer Dd in the CPU 11 detects the continuous-copy command.

(s22) If the judging unit makes a judgment of power stored in the capacitor 17 during the continuous passing of the paper to be less than the threshold for starting electric discharge, or of the board paper being passed continuously (the cardboard mode button 31 is put ON), or if the paper being passed continuously when the amount of image data to be fixed on the recording medium is large (the photo mode button 32 is put ON), the mode selector 11B selects the mode 2.

(s23) Then, firstly, the velocity (rotational speed: i.e. linear velocity) of the transporting section (such as a drive roller) that carries the recording medium to the fixing roller 91 is set to be the linear velocity b and the interval between the recording mediums, i.e. the paper interval when the recording medium is carried continuously, is set to be the paper interval L. Secondly, the rotational velocity of the fixing roller 91 and the pressurizing roller 92 is set to be a velocity corresponding to 40 copies per minute. The control is performed so that the velocity can be reduced to 40 copies per minute.

(s24) Each of the main sections (including the fixing-unit system 10) involved in the continuous operation of the image forming apparatus is let to be in the standby state.

(s25) The start-up operation by supplying the power from the commercial power supply to the heater 93 is performed by the control of the CPU 11. After the start-up operation, the judging unit detects the information about temperature based on the temperature measurement of the fixing roller 91 from the temperature sensor 95 and makes a judgment of whether the fixing roller 91 has reached the reload temperature. The start-up operation of the fixing roller 91 takes 30 s.

(s26) If the temperature of the fixing roller 91 has reached the reload temperature, the standby state of the main section (including the fixing-unit system) involved in the continuous-copy operation of the image forming apparatus is released and the copy-start switch Csw is let to be operative. The heater 93 continues to generate heat, thereby heating the fixing roller 91.

(s27) With the continuous copy operation, by heating of the fixing roller 91 and a nip pressure of the pressurizing roller 92, unfixed toner images on each of the sheets P are fixed one after another at the linear velocity b during continuous passing of the paper at 40 copies per minute.

(s28) When the copying operation is completed, the capacitor 17 is charged by the commercial power supply 16 as a preparation for the next copying operation. The stored-power energy upon charging is 25 V for example.

According to the first embodiment, if the power stored in the capacitor 17 during the continuous passing of the paper is less than the threshold for starting electric discharge, or if the board paper is passed continuously (the cardboard mode button 31 is put ON), or if the paper is passed continuously when the amount of image data to be fixed on the recording medium is large (the photo mode button 32 is put ON), the mode selector 11B can perform control by a control mode that is similar to reducing the number of copies per minute to 40. This enables to reduce greatly the labor required for designing, making, and simulating the control program, and in turn enables to reduce time and cost of manufacturing the image forming apparatus (fixing-unit system 10).

Figure 3:
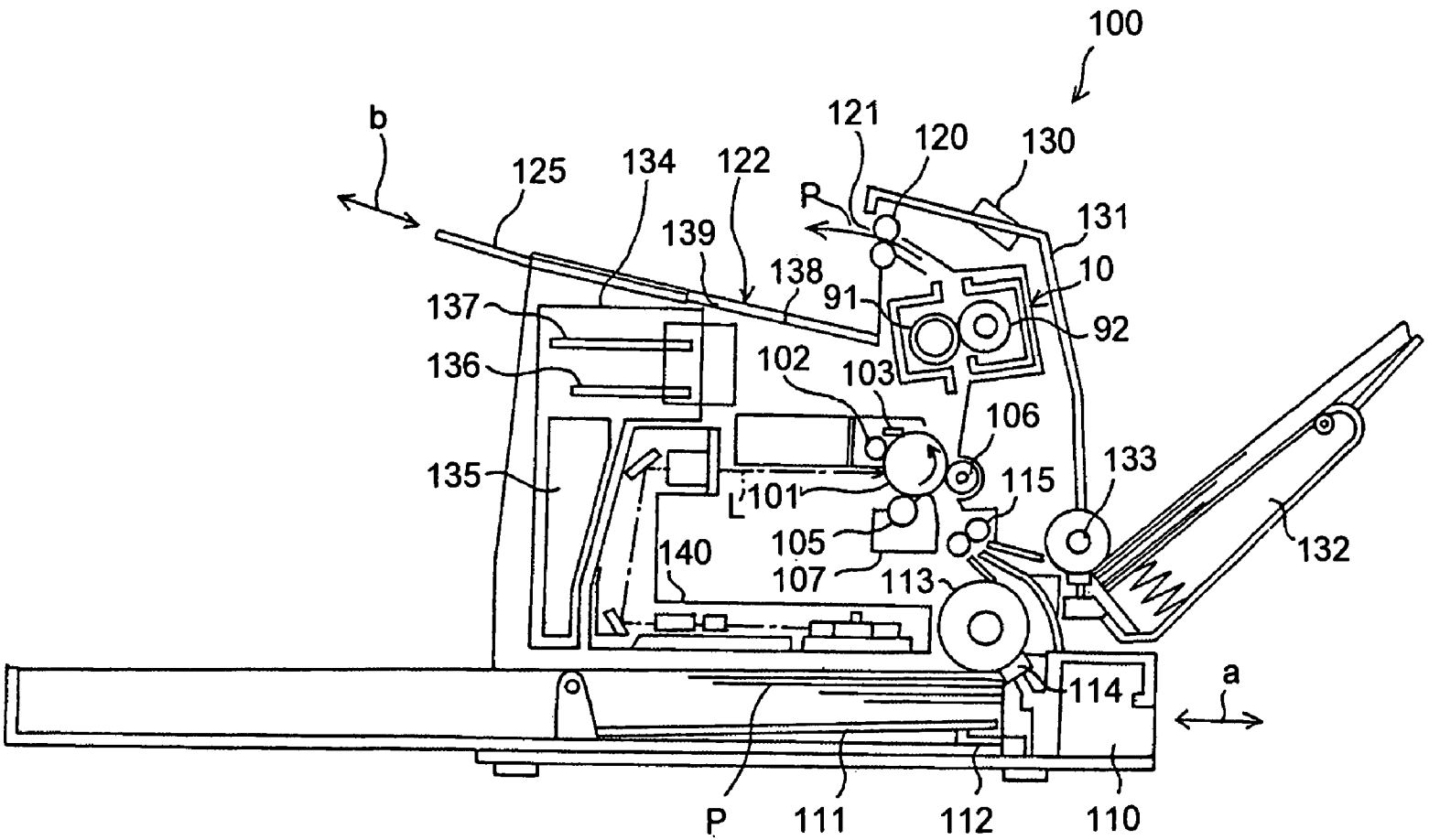
FIG. 3 is a cross-section of an image forming apparatus according to the first embodiment.

FIG. 3 is a cross-section of the fixing-unit system 10 that is included in an image forming apparatus 100. The image forming apparatus 100 shown in FIG. 3 has an electrophotography mechanism that includes a photosensitive drum 101, a charging unit 102, a laser optical system 140, and a developing unit 107. The photosensitive drum 101 is an image carrier. The charging unit 102 charges the photosensitive drum 101 uniformly. The laser optical system 140 exposes a laser beam L to the photosensitive drum 101 after the photosensitive drum 101 is charged and forms an electrostatic latent image. The developing unit 107 develops the electrostatic latent image on the photosensitive drum 101. The toner image on the photosensitive drum 101 is transferred by a transferring unit 106 to a sheet P that is supplied from a paper feeding cassette 110. The sheet P with the toner image formed on it is then forwarded to the fixing-unit system 10. In the fixing-unit system 10, the toner image is heated by the fixing roller 91 and the pressurizing roller 92, thereby fixing the toner on the sheet P.

In the image forming apparatus 100, when a main power supply is put ON, each section of the image forming apparatus is started and the fixing-unit system 10 performs the start-up operation. A judging unit 11*c* detects power stored in the capacitor 17 on one hand, and each required section including the fixing unit comes to the standby state and the heater 93 generates heat and enters into start-up operation. In the image forming operation, if the power stored in the capacitor 17 during the continuous passing of the paper is less than the threshold for starting electric discharge, or if the board paper is passed continuously (the cardboard mode button 31 is put ON), or if the paper is passed continuously when the amount of image data to be fixed on the recording medium is large (the photo mode button 32 is put ON), after the number of copies per minute is set to 40, the CPU 11 allows the heater 93 of the fixing unit to generate heat. When the start-up operation is over (reload temperature is reached) the standby state is cancelled and the copy-start switch Csw is let to be operative. Moreover, the heater 93 is allowed to generate heat with the image forming operation for the continuous passing of the paper.

In this case, if any of the three cases viz. the case where the power stored in the capacitor 17 during the continuous passing of the paper is less than the discharge-starting threshold voltage, the case where the board paper is passed continuously (the cardboard mode button 31 is put ON), and the case where the paper is passed continuously when the amount of image data to be fixed on the recording medium is large (the photo mode button 32 is put ON) is detected, the control can be performed by the control mode that is identical to reducing the number of copies per minute to 40. This enables to reduce greatly the labor required for designing, making, and simulating the control program, and thereby enables to reduce time and cost of manufacturing the image forming apparatus. Moreover, the passing of the board paper or passing of the paper when the amount of image data to be fixed on each recording medium is large can be detected in advance and the CPM down control (control by reducing the copies per minute) can be performed right from the beginning. This enables to shorten time for the overall image formation.

According to the present invention, it is possible to simplify the control system and greatly reduces labor required for designing, making, and simulating a control program. It is also possible to reduce time and cost of manufacturing an image forming apparatus.

Moreover, according to the present invention, it is possible to shorten a total copying time.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus comprising:

a capacitor that is charged by a commercial power;

a heating unit that is heated by power supplied by the commercial power and the capacitor;

a fixing member that is heated by the heating unit, and that applies heat on an image to be fixed to fix the image on a recording medium;

a power detector that detects energy of power stored in the capacitor;

a judging unit that judges whether it is possible to supply power to the heating unit from the capacitor when a plurality of the recording mediums is continuously passed through the fixing member; and a controller that performs a reducing control to reduce number of copies of the image formed per minute, when the judging unit judges that it is impossible to supply the power to the heating unit from the capacitor.

2. The image forming apparatus according to claim 1, wherein the reducing control is a same control as a reducing control that is performed when a recording medium that has a high heat capacity is passed through the fixing member and when a recording medium to which an image having a large amount of data is to be fixed is passed through the fixing member.

3. The image forming apparatus according to claim 1, wherein the reducing control is a control to reduce a linear velocity of the recording medium to be passed.

* * * * *